US005599068A

United States Patent [19]

Kelly et al.

[11] Patent Number: 5,599,068

[45] Date of Patent: Feb. 4, 1997

[54] ARCUATELY SUPPORTED CHAIR

[75] Inventors: Ray G. Kelly; Sharon A. Turnbough, both of St. Louis, Mo.; James McJunkin, San Diego, Calif.

[73] Assignee: Angeles Group, Inc., Pacific, Mo.

[21] Appl. No.: 634,129

[22] Filed: Apr. 15, 1996

Related U.S. Application Data

[63] Continuation of Ser. No. 243,761, May 17, 1994, abandoned.

[51] Int. Cl.[6] ..... A47C 1/12

[52] U.S. Cl. ..... 297/448.1; 297/451.13; 297/452.14; 297/DIG. 2; 297/239

[58] Field of Search ..... 297/44.01, 440.14, 297/440.23, 440.24, DIG. 2, 452.14, 445.1, 448.1, 449.1, 450.1, 451.11, 451.13, 452.2, 239

[56] References Cited

U.S. PATENT DOCUMENTS

| | | | |
|---|---|---|---|
| D. 236,670 | 9/1975 | Uyoda | D6/375 |
| D. 239,345 | 3/1976 | Keller | D6/375 |
| D. 340,812 | 11/1993 | Estomin et al. | D6/334 |
| D. 346,281 | 4/1994 | Vidal | D6/370 |
| D. 347,741 | 6/1994 | Vidal | D6/370 |
| 3,031,227 | 4/1962 | Van Buren, Jr. | 297/DIG. 2 X |
| 3,669,496 | 6/1972 | Chisholm | 297/445 |
| 3,695,702 | 10/1972 | Ingellis | 297/440.24 |
| 3,698,150 | 10/1972 | Anderson | 297/445 |
| 3,873,154 | 3/1975 | Baker, Jr. | 297/445 |
| 4,609,225 | 9/1986 | Loncks | 297/DIG. 2 X |
| 5,071,191 | 12/1991 | Leib | 297/445 |
| 5,094,507 | 3/1992 | Gibbs | 297/448.1 X |

FOREIGN PATENT DOCUMENTS

| | | | |
|---|---|---|---|
| 4012750 | 5/1966 | Netherlands | 297/440.23 |

*Primary Examiner*—Milton Nelson, Jr.
*Attorney, Agent, or Firm*—Paul M. Denk

[57] ABSTRACT

A safe and stackable molded plastic chair having a structurally reinforced molded plastic body portion comprised of an integral seat and back rest employing generally curvilinear lines. An integral molded plastic mounting boss, having a hole formed therethrough, is formed on each corner of the seat. An arch-shaped, tubular plastic leg element having two legs is attached to each side of the seat by bolts inserted through the holes in the bosses. The bolt head seats in a recess formed in the boss. The bolt engages an arcuately shaped combination brace and fastener element situated with the tubular leg adjacent each mounting boss. During assembly, the brace and fastener element is positioned within the tubular leg by a removable, elongated magnetic or threaded rod until the bolt is sufficiently tight to draw the leg against the boss. The rod is removed leaving no exposed mounting hardware. A plug is inserted in the open end of each leg and a plastic sleeve covers the plug and leg end.

16 Claims, 5 Drawing Sheets

ARCUATELY SUPPORTED CHAIR

CROSS REFERENCE TO RELATED APPLICATION

This application is designated as a continuation of the application of the same inventor, having Ser. No. 08/243,761, filed on May 17, 1994 and now abandoned, said application being owned by a common assignee.

BACKGROUND OF THE INVENTION

This invention relates generally to furniture, more particularly to a sturdy, easy to assemble, stackable chair for use by small children in the institutional setting, such as a nursery or school. Although, the chair may also have customary usage.

Classroom or institutional furniture is known in the art. Chairs, for example, that are used by small children in the preschool classroom have traditionally been downsized replicas of full size institutional furniture. Quite often these chairs lack aesthetic appeal in that they do not blend in well with other preschool type furniture. More importantly, these chairs are not primarily designed with safety in mind. For example, such furniture is designed to fold for storage, which can create a pinching hazard. The furniture also may have gaps in which a small child may catch an arm or leg. Furthermore, such prior art furniture may have corners.

Traditional, downsized furniture, may also lack functionality. This type of furniture may be heavy and difficult to move about the classroom. The furniture may not stack for convenient storage and it may be constructed of a material that lacks durability. For example, furniture constructed of wood is easily damaged, can be marred and defaced, and is difficult to keep clean. Traditional furniture, if shipped unassembled, can be quite difficult to assemble for use, requiring the application of tools not routinely found in the classroom environment.

SUMMARY OF THE INVENTION

It is therefore a principal object of the present invention to provide a molded plastic chair for use in a preschool classroom that has aesthetically pleasing, rounded lines as well as unique functional and safety features.

It is another object of the present invention to provide a molded plastic chair for use in a preschool classroom that can be shipped in a nestable manner.

Still a principal object of this invention is to provide a chair that is tip proof and one that can be safely utilized by the children in a preschool or early learning setting.

Yet another object of this invention is to provide a arcuately supported chair that can be utilized for general chair purposes, whether it be for the child or adult usage, and which is stabily constructed so as to prevent tipping when maneuvered.

Yet another object of the present invention is to provide a molded plastic chair for use in a preschool classroom that is readily stackable for storage.

Still another object of the present invention is to provide a molded plastic chair for use in a preschool classroom that is totally safe.

A still further object of the present invention is to provide a molded plastic chair for use in a preschool classroom that is lightweight, durable, easy to keep clean, attractive, inexpensive to manufacture, and well suited for its intended purposes.

Yet another object of this invention is to provide an arcuately supported chair which includes protective sleeves for their legs and which prevents untimely sliding of the chairs, during usage, is generally noise proof as a result of the provision of such sleeves at the lower ends of the arcuately formed legs for each chair, and in addition, prevents the development of rust rings, particularly such as occurs when chairs of this type are fabricated having legs made of metal, and utilized upon a floor that is frequently damp mopped or otherwise washed.

Briefly stated, a safe and stackable molded plastic chair for use in a preschool classroom is provided having a molded plastic body with an integral seat and back rest sections employing generally curvilinear and rounded lines. An integral molded plastic mounting boss, having a bolt hole formed therethrough, is formed on each corner of the seat. The bolt holes are generally recessed upon the underside of the chair and thereby are reasonably concealed and tamperproof. An arch-shaped tubular plastic leg element having two legs is attached to each side of the body section of a chair, the legs being design contoured to prevent their tipping and enhancing their stability. Each leg is attached to a seat by a bolt inserted through the hole formed in each boss of the seat. The bolt head seats in a recess formed in the mounting boss, and thereby is generally tamperproof. The bolt engages an arcuately shaped, combination brace and fastener element situated within the tubular leg adjacent each mounting boss. During assembly, the brace and fastener element is held in place within each tubular leg adjacent to the mounting boss by a removable, elongated support rod. The brace and fastener element is held in place by the rod until the bolt is sufficiently tightened to draw the brace and fastener element, as well as the leg, against the mounting boss of the seat. The elongated rod is then removed while the bolt head remains recessed within the mounting boss leaving no exposed mounting hardware after assembly. A rounded plastic plug is inserted in each open end of the tubular leg sections. A protective, flexible plastic sleeve is placed over each end of the legs and plug, and useful for preventing sliding of the chair, and averts the development of rust rings.

DESCRIPTION OF THE PREFERRED EMBODIMENT

Figure 1:
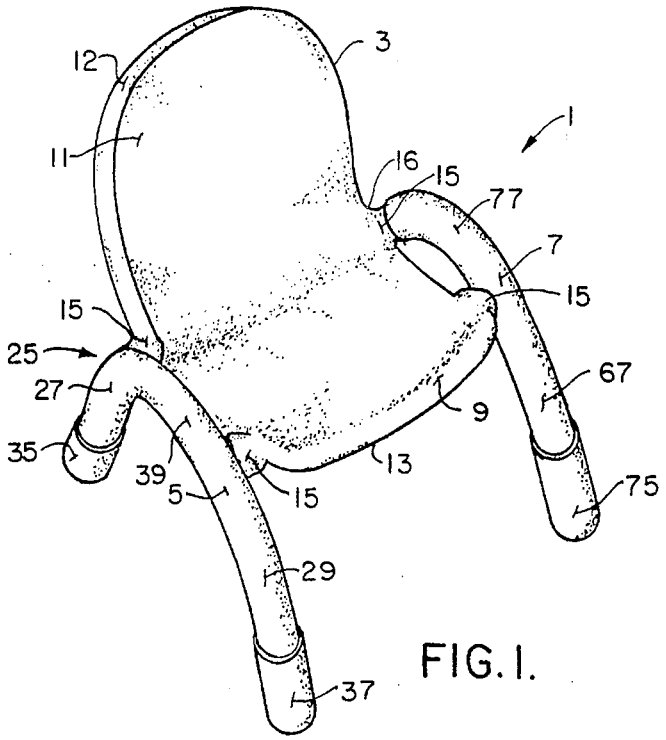
FIG. 1 is a perspective view of the molded classroom, nursery, or general chair made in accordance with the principles of the present invention.
Figure 2:
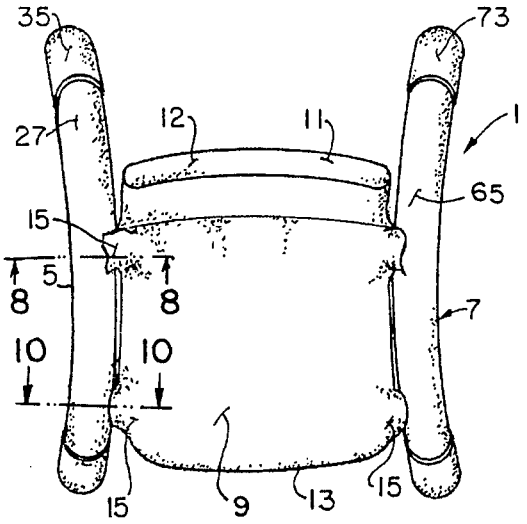
FIG. 2 is a top plan view of the chair of the present invention.

The chair constructed in accordance with the principles of the present invention is indicated generally by reference numeral 1 in the drawings. Chair 1 has a molded plastic body section 3 and a pair of arch shaped tubular leg elements 5 and 7. Body 3 has a generally contoured or curvilinear profile with an integral seat 9 and integral back rest 11. Back rest 11 has a rounded or arcuate outer edge 12 and seat 9 has a generally arcuate or rounded outer edge 13. Body 3 is manufactured in accordance with processes known to the art, including injection molding of resin material or other appropriate method of manufacture.

Figure 3:
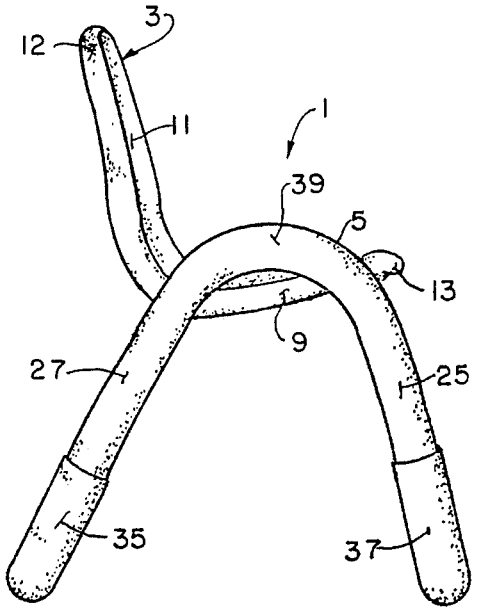
FIG. 3 is a side elevational view of the chair of the present invention.
Figure 4:
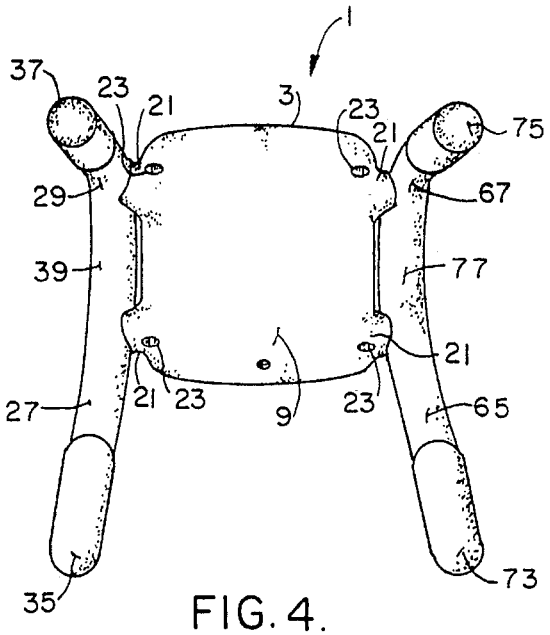
FIG. 4 is a bottom plan view of the chair of the present invention.
Figure 5:
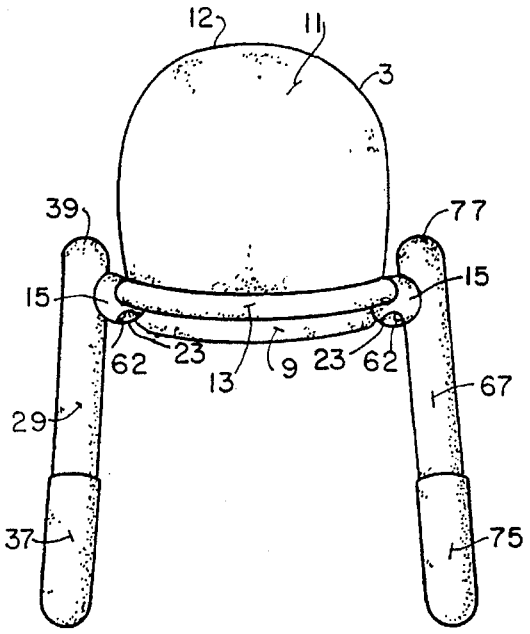
FIG. 5 is a front elevational view of the chair of the present invention.
Figure 6:
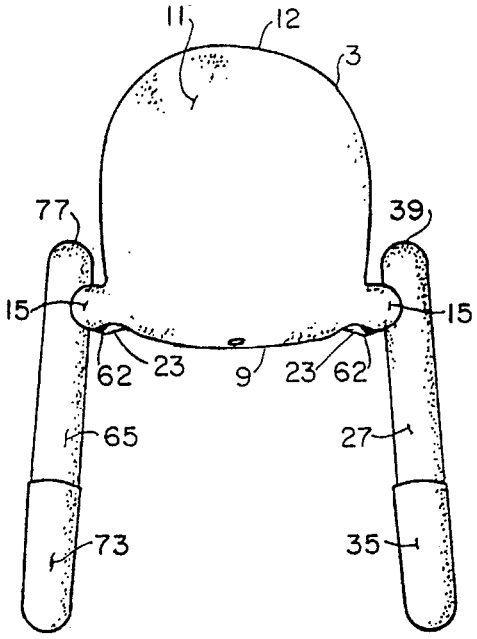
FIG. 6 is a rear elevational view of the chair of the present invention.
Figure 7:
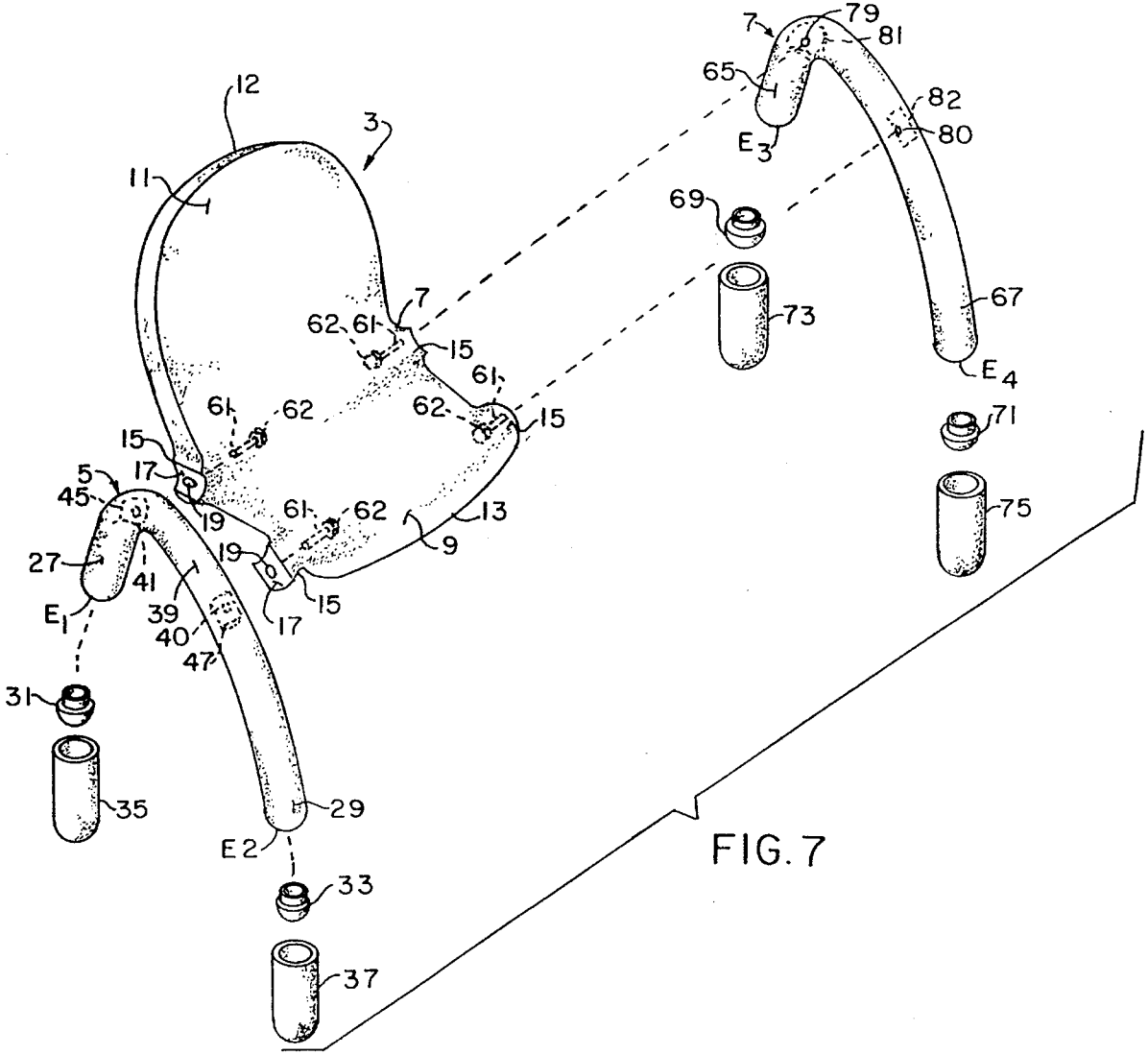
FIG. 7 is an exploded view of the chair of the present invention.

Seat 9 has four bosses 15 integrally formed on each corner of the seat. As can be seen in FIG. 7, each boss has an arcuate face 17 and a hole 19 formed therethrough. The bottom surface 21 (FIG. 3) of boss 15 has a recess 23 formed therein. This recess enhances the tamper resistance of the chair of this design.

A first arch-shaped leg element 5 is situated adjacent a first side of seat 9. Leg element 5 is a arch-shaped, tubular structure with two open-ended legs 27 and 29. Leg element 5 is made by curving or bending an elongated piece of PVC tubing or tubing made of any other appropriate material. Rounded plastic plugs 31 and 33 are inserted in the open ends E1 and E2 of legs 27 and 29 respectively. Sleeves 35 and 37 cover plugs 31 and 33 as well as ends E1 and E2 of legs 27 and 29 respectively. Plugs 31 and 33 are designed to keep open ends E1 and E2 from wearing through the sleeve as a result of downward pressure exerted during use. The sleeves are constructed from a durable common non-skid type material such as vinyl or other appropriate material. Bow 39, formed centrally by the bending of leg element 5, serves as both an arm rest and a lateral hip support. A pair of mounting holes 40 and 41 are formed through one side wall of bow 39 adjacent seat 9. Brace and fastener elements 45 and 47 are inserted in leg element 5 and are each positioned adjacent a boss 15. It is to be noted in FIG. 3 that the front part of each leg 27 and 29 is bent at a more vertical angle than the rear part of each leg, which, as can be seen, is slanted substantially rearwardly, at a greater length, and thereby provide further stability for the chair when used, and prevents tipping of the chair particularly when utilized by a younger child.

Figure 8:
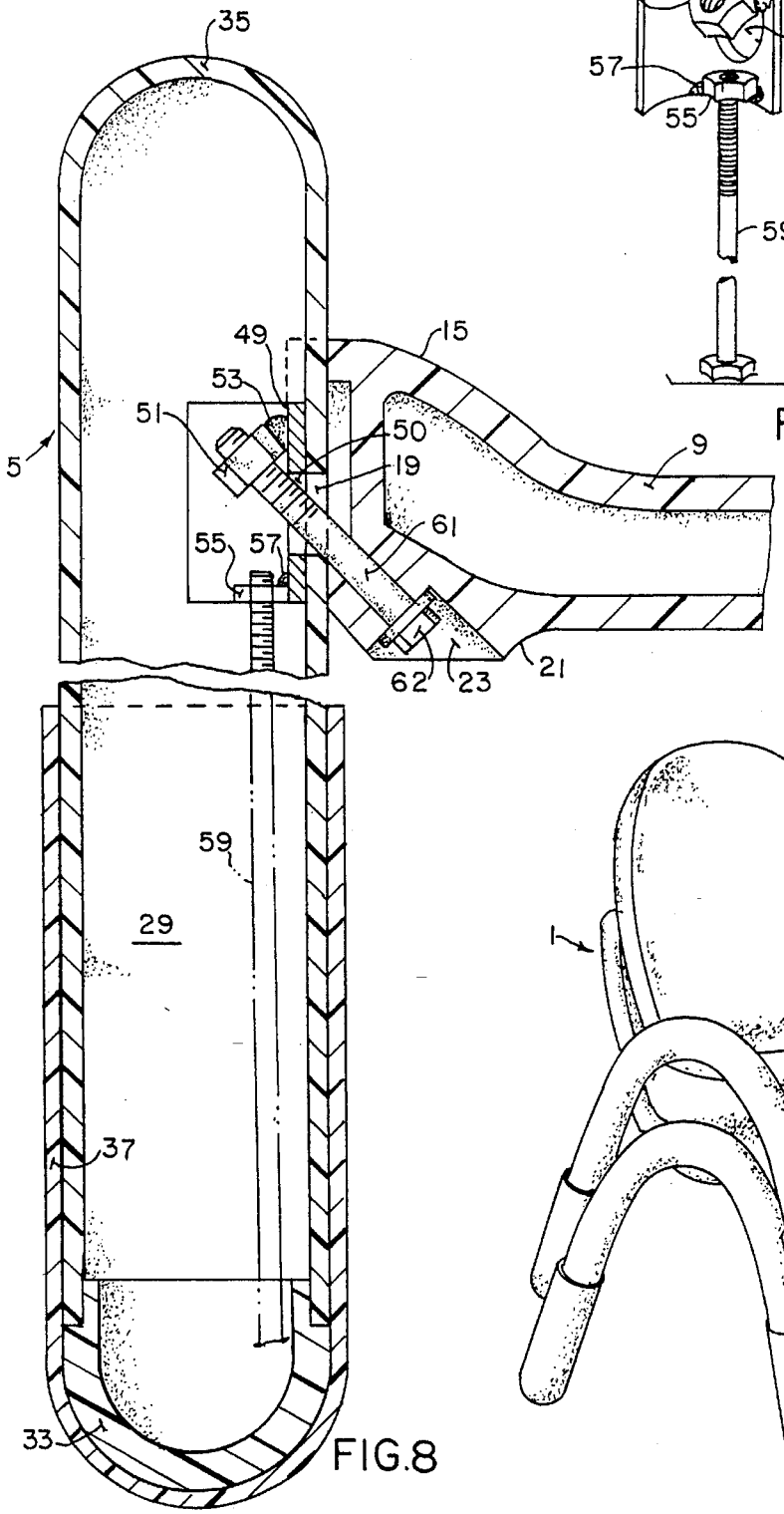
FIG. 8 is a partial cross section view of the picture of the leg element and seat of the chair of the present invention illustrating the assembly hardware.
Figure 8A:
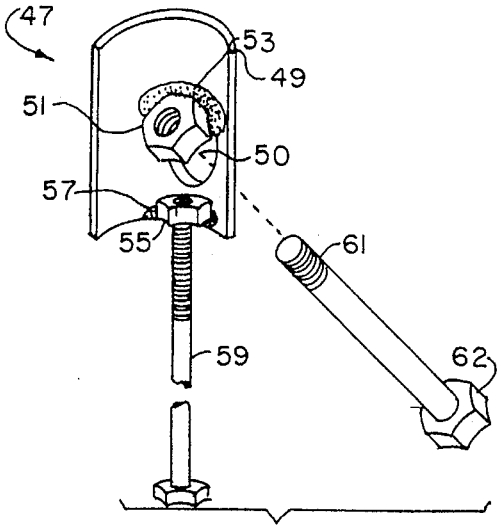
FIG. 8A is an exploded view of the combination brace and fastener elements.

The brace and fastener elements will now be described in detail. Brace and fastener element is best shown in FIGS. 8 and 8A. It should be noted that element 45, as well as the subsequent brace and fastener elements described below, are constructed in the same manner and function in the same manner as brace and fastener element 47. Element 47 has a semi-circular wall 49 having the same annular profile as the inside wall of tubular leg element 5 at bow 39 and the same as face 17 of boss 15. The substantial curvilinear nature of this wall 49, which extends substantially around the inner perimeter of the tubular leg element 5 and 7, in addition to having significant height, provides for a greater dissemination of the force generated through attachment of the leg to the seat, in this manner, and particularly when the seat is in usage, and impacting forces are applied to the chair, the load generated between these two components is significantly distributed by means of the substantial contact developed between the semi-circular wall 49, and the inner surface of the chair legs. Wall 49 has a hole 50 formed centrally therein. A first threaded nut 51 is secured at an angle to an upper section of wall 49 by weld 53 or other appropriate attachment means. A second threaded nut 55 is attached to wall 49 by weld 57 or other appropriate means at the lower end of wall 49. Elongated, removable threaded rod 59 is threadedly engages second nut 55. Bolt 61, with integral hex head 62 is inserted angularly through a slot inserted through recess 23, hole 19, hole 50, and threadedly engages first threaded nut 51.

During assembly of chair 1, holes 40 and 41 in bow 39 are each aligned with a hole 19 in a boss 15. The outside wall of leg element 5 rests flush with the arcuate face 17 of boss 15. Rod 59 is attached to brace and fastener element 47 at threaded nut 55. Rod 59 is grasped at the opposite end and the entire assembly is inserted within tubular leg element 5 until hole 50 in brace and fastener element wall 49 is aligned with hole 40 and hole 19 in boss 15. Bolt 61 is inserted through recess 23, hole 19, holes 40 and 50 and engages the first threaded nut 51. Bolt 61 is tightened drawing wall 49 against the interior wall of bow 39 thereby securing the exterior wall of bow 39 against arcuate face 17 of the boss 15. Rod 59 is unscrewed from second nut 55 and removed from the leg element 5. The respective plugs 35 and 33 are inserted in the open ends El, E2 of legs 27 and 29. Sleeves 35 and 37 are slipped over the ends E1 and E2 as well as plugs 31 and 33 of legs 27 and 29 respectively. Since hex head 62 of bolt 61 is drawn into recess 23 and since elongated rod 59 is removed from the assembly after the tightening of bolt 61, no mounting hardware is exposed.

Second arch shaped leg element 7 is situated adjacent a second side of seat 9. Leg element 7 is a mirror image of leg element 5, having two open ended legs 65 and 67. Plastic plugs 69, 71 are inserted at the open ends E3 and E4 of legs 65 and 67 respectively. As stated above, the plugs 69 and 71 serve to create a smooth, rounded surface at the ends E3 and E4 of the respective legs to prevent the legs from wearing through the respective sleeves. Sleeves 73 and 75 cover plugs 69 and 71 as well as open ends E3 and E4. Bow 77, formed centrally in leg element 7 serves as both an arm rest and a lateral hip support. Mounting holes 79 and 80 are formed on the wall of bow 77. Brace and fastener elements 81 and 82 are situated within bow 77 and are aligned with the respective bosses 15 formed on the second side of the seat 9. As previously stated, brace and fastener elements 81 and 82 are constructed, assembled, and function in a manner identical to brace and fastener element 47 as previously described.

Figure 10:
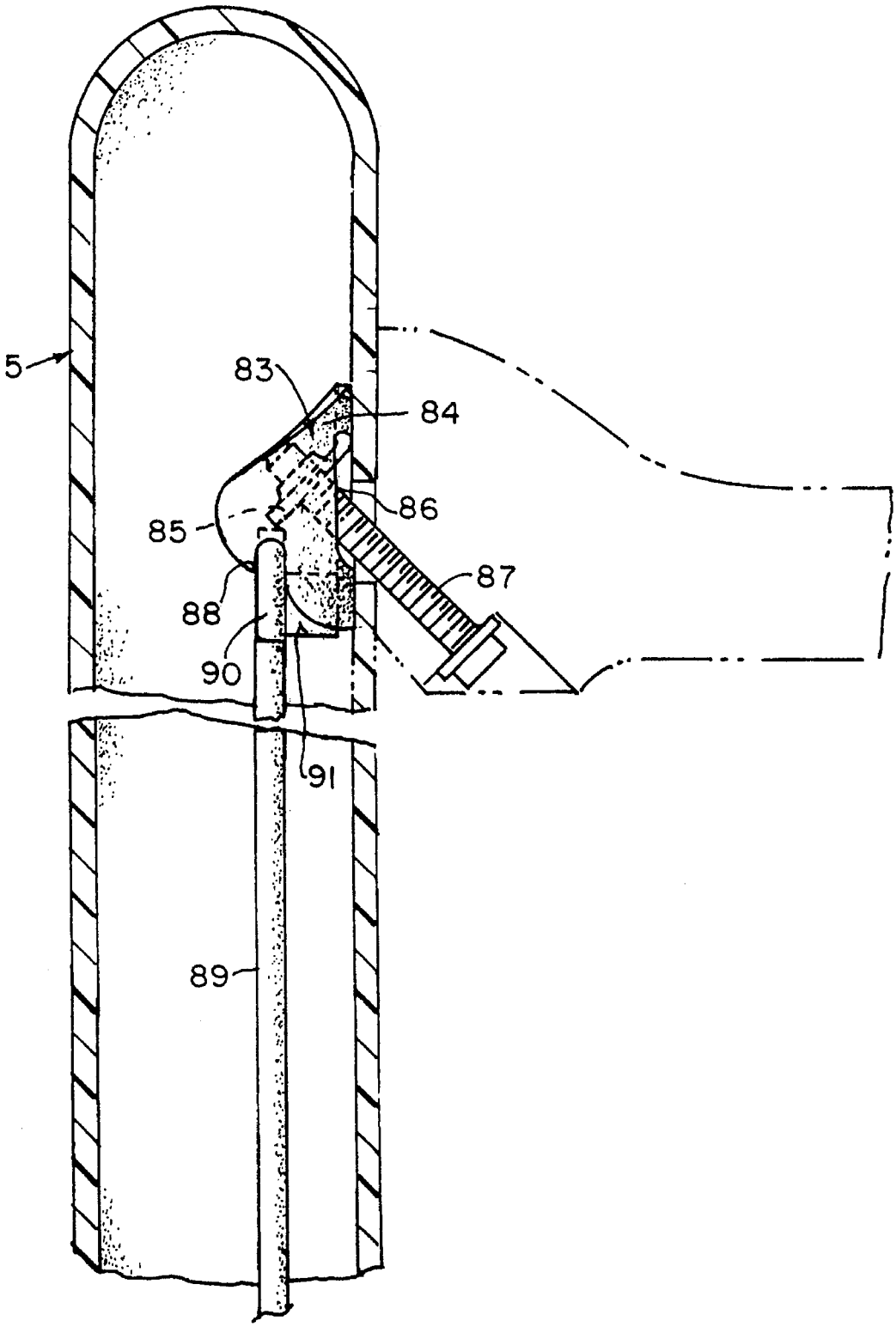
FIG. 10 is a partial cross-sectional view of the leg element and seat of the chair illustrating a further embodiment in the assembly hardware.

A further modification to the style of fastener element, in this particular instance the element 83, as shown, is disclosed in FIG. 10. This fastener element likewise contains a substantial sized semi-circular wall portion 84, and has punched through its front wall a tab 85, which has a threaded aperture, as at 86, provided therethrough, and into which a bolt 87 may fasten, as when securing a chair seat 3 to the various lateral leg elements. The wall 84 has a pair of slots, as at 88, provided on each side, and into which a fastening tool, such as the rod 89, may insert, through its lateral ears 90, in order to generally support the fastener 83 into position for aligning the seat apertures therewith, and to allow a bolt to be threadedly engaged within its apertures 86, upon tightening of the legs to the base of the seat 9. Furthermore, and to provide further stability for holding fastener in place, upon the tool or rod 89, a magnetic means 91 may be provided, securing upon the front of the rod 89, and against the inner surface of the circular wall member 84, to stabilize it in position, and to allow for its biasing against the adjacent interior surface of the leg 5, when initially aligning the leg into position for securement to the chair seat, and for arranging the fastener 83 into position for reception of its bolt 87. This is an alternative form of tool assembly that may be utilized during the installation and assembly of the designed chair of this invention.

Figure 9:
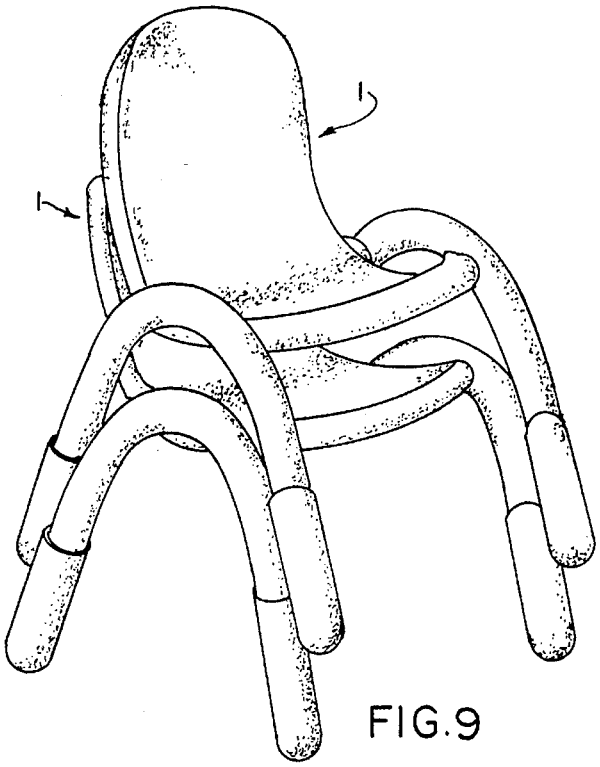
FIG. 9 is a perspective view of a pair of chairs of the present invention in a stacked arrangement.

FIG. 9 illustrates a pair of chairs 1 in a stacked arrangement. It should be noted that a plurality of chairs 1 can be stacked to allow convenient storage of the chairs.

It should also be noted that various changes and modifications may be made in the classroom chair as previously described and as illustrated in the drawings without departing from the scope of the appended claims. Therefore, the foregoing description and accompanying illustrations should be viewed as illustrative only and should not be construed in a limiting sense.

Having described the invention, what is desired to be claimed and secured by Letters Patent is:

1. A chair comprising, a molded plastic body, said body having a seat element and an integral back support, said seat element having a plurality of mounting bosses integrally formed thereon, one of each mounting boss formed proximate a corner of the seat element, each said mounting boss having a hole formed therethrough, a first arch-shaped tubular leg element having a first open-ended leg element and an integral second open-ended leg element adjacent a first side of said seat element, a first and second brace and a fastener element within said first arch-shaped tubular leg element, each said brace and said fastener element positioned adjacent one of said mounting bosses, a fastener inserted through said hole in each said mounting boss and engaging a corresponding fastener element integrally provided in each of said brace, a second arch-shaped tubular leg element having a first and an integral second open-ended leg elements adjacent a second side of said seat element, a third and fourth brace and a fastener element within said second arch-shaped tubular leg element, each said third and fourth brace and said fastener element positioned adjacent one of said mounting bosses formed on the second side of said seat element, a fastener inserted through the hole in each said mounting boss on the second side of said seat element and engaging a corresponding fastener element integrally formed in each said third and fourth brace and fastener element, a plug means closing the open-ended leg elements of the first and second arch-shaped tubular leg elements, whereby said seat element is rigidly secured to said first and second arch-shaped tubular leg elements.

2. The chair of claim 1 wherein each said fastener inserted through each said hole in each said boss is disposed to draw each said associated brace and fastener element against the interior wall of said arch-shaped tubular leg element, thereby holding said tubular leg element against said boss.

3. The chair of claim 1 and including sleeve means which overlap each of said plug means and each of said leg elements.

4. The chair of claim 1 wherein each said brace and fastener element has a detachable, elongated threaded rod for positioning said brace and fastener element within said tubular leg element adjacent said boss during assembly of the chair.

5. The chair of claim 1 wherein each said brace and fastener element has an arcuate profile complementary in shape to the interior profile of the tubular leg element with which it contiguously associates.

6. The chair of claim 5 wherein each said fastener comprises a bolt, and each said fastener element for engaging comprising a threaded aperture provided through the said fastener element.

7. The chair of claim 1 wherein each said arch-shaped tubular leg element is formed of high impact plastic.

8. The chair of claim 7 wherein each arch-shaped tubular leg element is unsymmetrical and integrally formed of a front component and rearwardly disposed portion, with the front component of each tubular leg element being more vertically arranged than the rearwardly disposed portion of each leg element.

9. The chair of claim 7 and further including one of said plug means being inserted into each of said open-ended legs.

10. The chair of claim 1 and including each tubular leg element having a downwardly disposed end, and said sleeve means overlapping each of said plug means and each of said leg elements proximate their said downwardly disposed ends.

11. The chair of claim 10 wherein each said brace and fastener element has a detachable, elongated rod for removably securing with each brace and fastener element, and positioning said brace and fastener element within said tubular leg element adjacent said boss during assembly of the chair.

12. The chair of claim 11 wherein said elongated rod has a pair of tabs extending therefrom for matingly engaging within corresponding slots provided within each brace and fastener element, and a magnet means further attaching with said rod for further holding said fastener element in position during its attachment of said tubular leg element with said chair seat element.

13. A nursery chair comprising:

a molded plastic body, said body having a seat and an integral back support, said seat having sides and providing laterally disposed mounting bosses integrally formed thereon, each mounting boss formed along a side of said seat and laterally disposing an arcuate face, and each mounting boss having a hole formed therethrough, a pair of arcuate shaped tubular leg elements, one of each tubular leg element located and connecting to the side of said seat, and each tubular leg element mounting contiguous against the arcuate face of the mounting bosses of said seat when assembled, fastener means extending through each mounting boss for securement of the seat to its adjacent arcuate tubular leg element, each tubular leg element having a pair of bottom ends, said leg elements being arranged to dispose the bottom ends of the tubular leg elements upon a supporting surface when the chair is utilized, and said chair being fully supported through the arranged arcuate legs when disposed to either lateral side of its seat.

14. The chair of claim 13 including a plurality of said chairs, said chairs being stackable one upon the other, through the nesting relationship of said chairs provided during stacking of the chairs and their arcuate leg elements one upon the other.

15. The chair of claim 13 wherein each arcuate shaped tubular leg element is unsymmetrical in design, each leg element having a frontal portion and a rearwardly extending back part, the frontal portion of each leg element extending more vertically downwardly than the rearwardly extending back part of each integral leg element.

16. The chair of claim 13 wherein the hole formed through each mounting boss is upwardly recessed, to provide for concealment of the fastener means therethrough upon attachment of the tubular leg elements to the chair seat.

* * * * *

UNITED STATES PATENT AND TRADEMARK OFFICE

CERTIFICATE OF CORRECTION

PATENT NO. : 5,599,068

DATED : Feb. 4, 1997

INVENTOR(S) : Ray G. Kelly, Sharon A. Turnbough, and James McJunkin.

It is certified that error appears in the above-indentified patent and that said Letters Patent is hereby corrected as shown below:

Claim 1, column 5, line 37, change "elements", first occurrence to ---element---.

Signed and Sealed this

Twenty-ninth Day of April, 1997

*Attest:*

*Attesting Officer*

BRUCE LEHMAN

*Commissioner of Patents and Trademarks*